US008770790B2

(12) United States Patent
Safar

(10) Patent No.: US 8,770,790 B2
(45) Date of Patent: Jul. 8, 2014

(54) CONTINUOUS ARRANGEMENT OF LIGHT CELLS INTO A MULTI-DIMENSIONAL LIGHT SOURCE

(75) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 237 days.

(21) Appl. No.: 13/439,024

(22) Filed: Apr. 4, 2012

(65) Prior Publication Data

US 2013/0265763 A1 Oct. 10, 2013

(51) Int. Cl.
*F21S 4/00* (2006.01)
*F21V 21/005* (2006.01)

(52) U.S. Cl.
CPC .. *F21S 4/00* (2013.01); *F21S 4/003* (2013.01); *F21V 21/005* (2013.01)
USPC ..... 362/249.01

(58) Field of Classification Search
CPC .... F21S 4/00; F21S 4/001–4/008; F21S 8/00; F21S 8/03; F21S 8/046; F21V 21/00; F21V 21/005
See application file for complete search history.

(56) References Cited

U.S. PATENT DOCUMENTS

| | | | | |
|---|---|---|---|---|
| 4,138,620 | A | 2/1979 | Dickson | |
| 4,173,035 | A | 10/1979 | Hoyt | |
| 4,204,273 | A | 5/1980 | Goldberg | |
| 4,899,086 | A | 2/1990 | Hirata et al. | |
| 5,336,345 | A | 8/1994 | Gustafson et al. | |
| 5,485,355 | A | 1/1996 | Voskoboinik et al. | |
| 5,552,679 | A | 9/1996 | Murasko | |
| 5,976,613 | A | 11/1999 | Janusauskas | |
| 6,849,869 | B1 | 2/2005 | O'Regan et al. | |
| 7,080,926 | B2 * | 7/2006 | Chang | 362/249.14 |
| 7,088,222 | B1 * | 8/2006 | Dueker et al. | 340/321 |
| 7,109,661 | B2 | 9/2006 | Watanabe et al. | |
| 7,354,785 | B2 | 4/2008 | Kabay et al. | |
| 7,832,897 | B2 * | 11/2010 | Ku | 362/249.02 |
| 2001/0043472 | A1 | 11/2001 | Gibboney, Jr. | |
| 2002/0145873 | A1 | 10/2002 | Rahman | |
| 2006/0244377 | A1 | 11/2006 | Mushtaev | |
| 2007/0210321 | A1 | 9/2007 | Satou | |
| 2009/0296395 | A1 | 12/2009 | Tarko et al. | |
| 2010/0061089 | A1 | 3/2010 | Lin et al. | |
| 2010/0157584 | A1 | 6/2010 | Ho | |

* cited by examiner

*Primary Examiner* — Bao Q Truong

(57) ABSTRACT

A novel arrangement of light cells on a flexible or solid background into a multi-dimensional light source capable of unlimited configuration, which comprises of a mother cell that is connected to one source of electrical power and gets charged, subsequently charging all the other light cells and thus illuminating the entire light source with unlimited configuration.

7 Claims, 2 Drawing Sheets

CONTINUOUS ARRANGEMENT OF LIGHT CELLS INTO A MULTI-DIMENSIONAL LIGHT SOURCE

FIELD OF THE INVENTION

The present invention belongs to the field of light sources and more particularly relates to a novel arrangement of light cells into a multi-dimensional light source arranged in a continuous manner, connected to a single power source and capable of unlimited configuration.

BACKGROUND OF THE INVENTION

Light sources such as light emitting diodes (LEDs), Electroluminescence (EL), and organic light-emitting diodes (OLEDs) have paved the way for energy efficient lighting means. Oleg Vladimirovich Losev independently reported on the creation of an LED in 1927. Rubin Braunstein of the Radio Corporation of America reported on infrared emission from gallium arsenide (GaAs) and other semiconductor alloys in 1955. Braunstein observed infrared emission generated by simple diode structures using gallium antimonide (GaSb), GaAs, indium phosphide (InP), and silicon-germanium (SiGe) alloys at room temperature and at 77 kelvin.

In 1961, American experimenters Robert Biard and Gary Pittman working at Texas Instruments, found that GaAs emitted infrared radiation when electric current was applied and received the patent for the infrared LED. The first practical visible-spectrum (red) LED was developed in 1962 by Nick Holonyak Jr., while working at General Electric Company. In 1976, T. P. Pearsall created the first high-brightness, high efficiency LEDs for optical fiber telecommunications by inventing new semiconductor materials specifically adapted to optical fiber transmission wavelengths.

The first commercial LEDs were commonly used as replacements for incandescent and neon indicator lamps, and in seven-segment displays, first in expensive equipment such as laboratory and electronics test equipment, then later in such appliances as TVs, radios, telephones, calculators, and even watches (see list of signal applications). These red LEDs were bright enough only for use as indicators, as the light output was not enough to illuminate an area. The invention and development of the high power white light LED led to use for illumination Electroluminescence (EL) or the generation of light by the electrical excitation of light emitting phosphors has been around for many years. Electroluminescence was first observed in silicon carbide (SiC) by Captain Henry Joseph Round in 1907 who reported that a yellow light was produced when a current was passed through a silicon carbide detector. The first thin-film EL structures were fabricated in the late 1950s by Vlasenko and Popkov who observed that luminance increased markedly in EL devices when they used a thin film of Zinc Sulfide doped with Manganese (ZnS:Mn). Luminance was much higher in thin film EL (TFEL) devices than in those using powdered substances. Such devices however were still too unreliable for commercial use.

Organic light-emitting diodes (OLEDs) are transparent when turned off the devices could even be installed as windows or skylights to mimic the feel of natural light after dark—or to serve as the ultimate inconspicuous flat-panel television. In 2006 scientists studying OLEDs made a critical leap from single-color displays to a highly efficient and long-lived natural light source.

Despite various improvements and progress in the field, some of the major obstacles that still exist to effective use of light sources such as LEDs, ELs and OLEDs are problems of configuration in novel sizes, shapes and patterns, problems in easy connectivity between different light segments, low light output, susceptibility to moisture, problems of easy installation without many peripherals, cost effective manufacture, maximum utilization of minimal power sources and short life.

Accordingly, improvements are needed in the existing methods and structures that negate the above shortcomings in the existing systems.

The relevant prior art methods, which will deal with light sources, are as follows:

U.S. Pat. No. 4,138,620 describes a multi panel electroluminescent panel assembly in which an area extending over several panels may be uniformly illuminated by light produced by the panels, and over which non-illuminated areas, stripes or the like resulting from electrode contracts are eliminated. Each panel is constructed such that the light produced per unit area is substantially uniform throughout the panel, including that from an area immediately adjacent at least one edge thereof.

U.S. Pat. No. 4,173,035 describes a flexible lighting strip including a circuit of modular construction formed thereon, light emitting diodes connected to said circuit, and the circuit being connectable to control circuitry which provides selected energization to said circuit and the light emitting diodes for effecting a moving light.

U.S. Pat. No. 4,204,273 describes a flexible conductor of strip configuration including a pair of copper conductors laminated between a pair of insulating material layers. Illuminating comprising a plurality of miniature or sub-miniature light bulbs assembled in a longitudinal array along a preferably flexible and flat conductor.

U.S. Pat. No. 4,899,086 describes an electroluminescence light emission apparatus based on a switch circuit formed of a switch element and a thyristor connected in series across a DC power source. Electroluminescence light emission apparatus having a simple configuration and a low level of power consumption, while providing a satisfactory level of emitted light brightness and utilizes an electroluminescence element functioning to emit light in response to applied voltage pulses.

U.S. Pat. No. 5,336,345 describes an elongate electroluminescent light strip. An electroluminescent light element which has a semitransparent film is encapsulated in a moisture impervious material. A process for extruding such a strip is also provided.

U.S. Pat. No. 5,485,355 describes a cable like electroluminescent light source comprises at least two electrodes mutually disposed in such a way as to crate between them an electric field when a voltage is applied to them; at least one type of pulverulent electroluminophor dispersed in a dielectric binder and disposed in such proximity to the electrodes as to be effectively excited by the electric fields when created and to emit light of a specific color, and a transparent polymer sheath encasing the electrodes and the electroluminophor.

U.S. Pat. No. 5,552,679 describes an illumination system with a panel that is capable of producing electroluminescence function of the panel. An illumination system can emit electroluminescence light as well as reflect incident light received from an outside light source. A layer of phosphor is excited by a power source, and a reflective layer disposed on top of the phosphor layer reflects.

U.S. Pat. No. 5,976,613 describes a flexible thick film electroluminescent lamp and method of construction in which a single non-hygroscopic binder is used for all layers thereby reducing delamination as a result of temperature changes and the susceptibility to moisture. Thick film electroluminescent lamps comprise a phosphor between an optically transparent front electrode layer, and a back electrode layer, all covered by protective electrode layer. The two electrodes are generally planar layers, but may be grids of electrically conductive material disposed at right angles to each other so that the phosphor at selected grid coordinates can be excited.

U.S. Pat. No. 6,849,869 describes the luminous efficiency and radiance of light emitting diodes (LEDs) fabricated with conjugated organic polymer layers.

U.S. Pat. No. 7,109,661 describes an electroluminescent light emission system having electroluminescent light emitting layer containing electroluminescent light emitting elements. The AC electric field forming material on the one surface side enables an AC electric field to be generated in the electroluminescent light emitting layer with an AC voltage applied between the first electrode layer an the second electrode layer.

U.S. Pat. No. 7,354,785 describes an electroluminescent device having light emitting layer containing phosphor particles which protrude from a light emitting layer, and an electrode layer which conforms to the protrusions. Methods of constructing a lamp using a temperature above the softening temperature of the insulating layer of the device are also disclosed.

US Patent Publication no. 20010043472 describes a ribbon light string is formed from a reinforced ribbon carrying a light string. The ribbon may be reinforced with peripheral reinforcing wires so that it may be shaped in decorative ways.

US Patent Publication no. 20020145873 describes a ribbon light assembly comprising a substrate and at least one light string releasably intertwined with the substrate. Each light string is formed of a plurality of lamp sockets and a plurality of lamp sockets and a plurality of wires connecting the lamp sockets. Each of the lamp sockets is substantially disposed on one substrate surface, and each of the wires is substantially disposed on an opposite surface. An opposite surface which receives at one element thereto, maintain the lamp sockets in a fixed pattern on the substrate.

US Patent Publication no. 20060244377 describes an electroluminescent light source has an elongated insulating transparent polymer sheaths having longitudinal axis of the sheath and connectable to a power source; a plurality of elongate electroluminescent layers partially surrounding one of the electrodes. Each electrodes having outer surface is partially surrounded by a respective one of the electroluminescent layers and being provided with a light reflecting coating.

US Patent Publication no. 20070210321 describes an edge light-emitting device having, on a light permeable substrate, a stacked structure including a pair of electrodes and at least one light emitting layer interposed between the electrodes, in which light emission is taken-out from a light emitting edge other than the light emitting edge of the stacked structure.

US Patent Publication no. 20090296395 describes that the present invention provides a light strip comprises an elongate core layer of insulating material having a plurality of light mounting apertures extending through the core layer. A light strip comprising of light emitting diodes connected at longitudinally spaced positions between a pair of longitudinally extending conductive elements of forming the light strip. A core layer spans in the longitudinal direction adjacent each one of the two opposed faces of the elongate core layer to enclose opposing ends of the light mounting apertures with the light emitting diodes therein.

US Patent Publication no. 2010057584 describes a light emitting strip structure with light guiding effect, which is hallow light guide strip body made of transparent material. A light guide strip body is formed with an axial internal chamber. Multiple recessed/raised sections are formed on a wall of the internal chamber for deflecting or reflecting light projected into the internal chamber from a light source.

US Patent Publication no. 20100061089 describes a flexible light strip includes an electrical-conductive layer, a plurality of light emitting units, an insulating layer and a heat-conducting layer. The light emitting units are adhered to the electrical-conductive layer and are electrically connected thereto. The insulating layer is overlapped on one surface of the electrical-conductive layer. The insulating layer is provided with a plurality of through holes for allowing the light emitting units to pass through. The heat conductive layer is adhered on the electrical-conductive layer.

However the purpose and methodology of all the above inventions that are part of prior art do not envisage the unique embodiment of several light cells that are in LED, or Electroluminescence (EL) or any other efficient light source that constitute a multi-dimensional light source consisting of a mother cell and several sister cells as required that can be arranged in a continuous manner and is capable of unlimited configuration.

Thus it is desirable to provide a system of light cells that can be effectively used without using PCB motherboard, hard connection electrical wires or welding that could be placed on an adhesive tape, cloth, or hard surface of unlimited dimensions and powered using a single power source.

It will be apparent to those skilled in the art that the objects of this invention have been achieved by providing mobile terminal with a spin menu, which is unique in nature, unlike existing menu selection models in mobile terminals that are suited only for limited purposes. Various changes may be made in and without departing from the concept of the invention. Further, features of some stages disclosed in this application may be employed with features of other stages. Therefore, the scope of the invention is to be determined by the terminology of the following description, claims, drawings and the legal equivalents thereof.

SUMMARY OF THE INVENTION:

The present invention may be summarized, at least in part, with reference to its objects.

It is therefore a primary objective of the present invention to provide a novel arrangement of light cells that can be arranged into a multi-dimensional light source in a continuous manner with one mother cell and as many sister cells as required connected to the mother cell.

Another objective of the present invention is to provide a novel arrangement of light cells that can be connected to a single power source.

Another objective of the present invention is to provide a novel arrangement of light cells that is capable of unlimited configuration.

Another objective of the present invention is to provide a novel arrangement of light cells that could be placed on an adhesive tape, cloth, or hard surface of unlimited dimensions.

Another objective of the present invention is to provide a novel arrangement of light cells that can be cut with the adhesive tape at any length and dimension and attached to any other part of the tape.

Another objective of the present invention is to provide a novel arrangement of light cells that requires no hard connectivity, electrical wires, PC Board, soldering or any other conventional electrical wiring.

Another objective of the present invention is to provide a novel arrangement of light cells that can be used for household and commercial lighting, all kinds of holiday decorations, arts and commercial advertising.

A further objective of the present invention is to provide a novel arrangement of light cells that is flexible, easily adaptable to newer requirements, moisture proof, and easy to install and maintain.

The invention described herein thus comprises a novel arrangement of light cells that are in LED or Electroluminescence (EL) or any other efficient light source and are placed adjacent to each other and touching each other to form a continuous and multi dimensional light source without using PCB motherboard, hard connection electrical wires or welding. The present invention can be placed on an adhesive tape, cloth, hard surface or any adhesive tape for unlimited dimensions. A surface such as an adhesive tape containing the present invention can be cut at any length and place it to any part of the surface. When such cutting happens, the present invention does not need to have another source for every such tape and extra tools and materials, a single power source is sufficient.

The above summary is intended to illustrate exemplary embodiments of the invention, which will be best understood in conjunction with the detailed description to follow, and are not intended to limit the scope of the invention.

Additional objects and embodiments of the invention will be set forth in part in the description which follows, and in part will become apparent to those skilled in the art upon examination of the following, or may be learned by practice of the invention. Thus these and other objects of the present invention will be more readily apparent when considered in reference to the following description and when taken in conjunction with the accompanying drawings.

DETAILED DESCRIPTION OF THE INVENTION

The following description is presented to enable any person skilled in the art to make and use the invention, and is provided in the context of particular applications of the invention and their requirements.

The present invention may involve novel systems and processes to implement the said invention. For example, although a series of processes may be described with reference to a diagram, the order of processes may differ in other implementations when the performance of one process is not dependent on the completion of another process. Further, non-dependent processes may be performed in parallel. Thus, the present invention is not intended to be limited to the embodiments shown.

Figure 1:
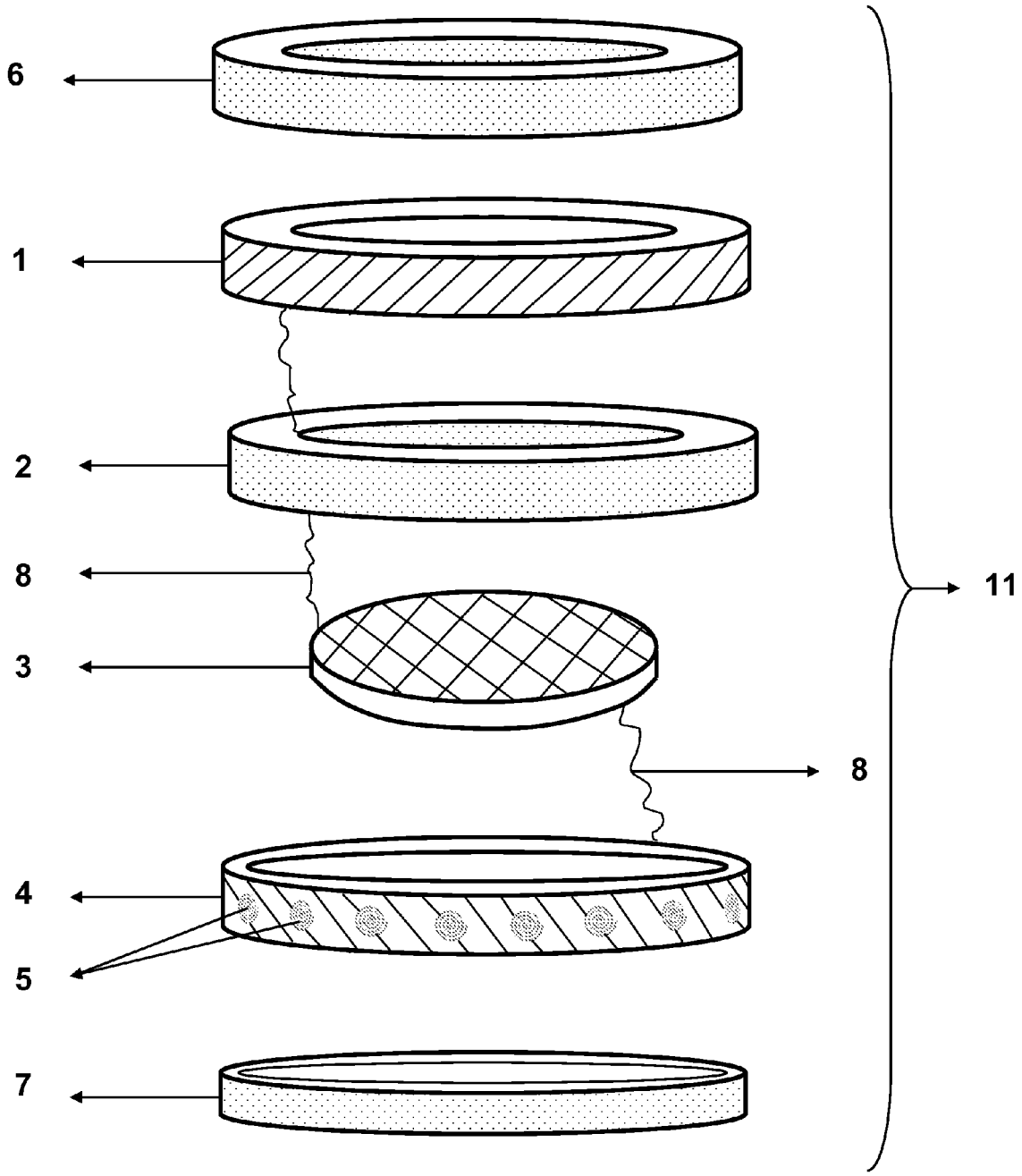
FIG. 1 is a diagram showing the parts of a mother cell of the present invention.
Figure 2:
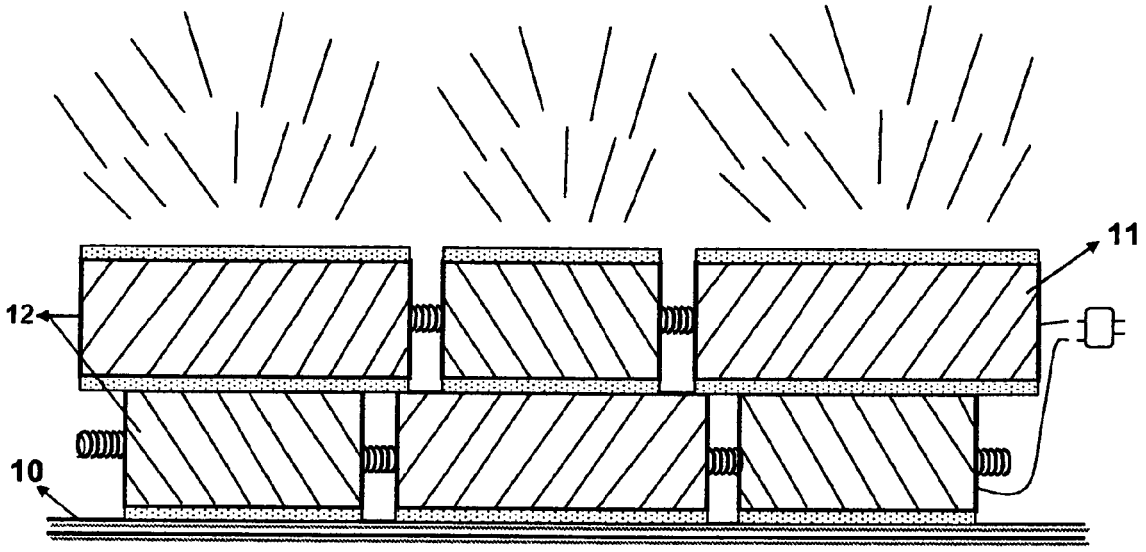
FIG. 2 is a diagram showing the connection of the mother cell to sister cells on a background material and working of the present invention.

The present invention can be configured as follows:

As illustrated in FIG. 1 and FIG. 2 a primary unit of the present invention that is electrically powered, is called the mother cell (11) comprising of a large ring (1), non-conductive material rings (2) and (6), a small ring (4), non-conductive material (7), any efficient light source (3) including but not limited to an LED or Electroluminescence (EL), copper springs (5), an electrical wire (8), and a background holding material (10) such as adhesive tape.

In a preferred embodiment of the present invention, the mother cell (11) is the first cell that connects to power source. A large ring (1) in a mother cell (11) has non-conductive material ring (2) and (6) on both sides of the large ring (1). The large ring (1) in a particular mother cell (11) acts as a connector to any side of another mother cell (11). A large ring (1) thus passes electrical current to the light source (3) via the electrical wire (8). A small ring (4) acts as a connector to any other mother cell and has non-conductive material (7) on one side of the small ring (4).

The small ring (4) passes electrical current to the light source (3) via an electrical wire (8). The copper springs (5) in the present invention improve electrical connectivity among the various mother cells (11), and provides flexibility by facilitating bending between mother cells (11) so that they can be arranged in various configurations not restricted to a straight line and including a spherical or other configuration. This makes it possible to create diverse kinds of unconventional configurations to create a particular larger light pattern. Further due to the copper springs (5), the mother cells (11) need not be arranged on a conventional hard background surface but can be arranged on any flexible background material (10).

In a preferred embodiment of the present invention, the mother cell (11) connects to an AC or CD electrical source. From the mother cell (11), electrical power is transferred to the remaining cells called sister cells (12) when they are connected to the mother cell (11). Miniature transformers ensure electrical current transfer to the sister light cells (12) that are situated away from the mother cell (11). The large rings (1) and the small rings (4) of a mother cell (11) thus act as a connector of any side and passes the electrical current through the sister cells (12) to the light source (3).

In a preferred embodiment of the present invention, as depicted in FIGS. 1 and 2, several LED cells or electroluminescent EL cells or any other efficient light sources (3) are placed adjacent to each other on any background holding material (10) such as an adhesive tape, cloth, or a hard surface having unlimited dimensions, with each light source (3) touching each other to form a continuous and multi dimensional light source without using PCB motherboard, hard connection electrical wires or welding. The single mother cell (11) among the light cells connects to a power source and from there it passes on the electrical power to sister cells (12). These sister light cells (12) are arranged in a continuous manner, therefore a sister light cell (12) gets illuminated by contacting another sister light cell (12) that is placed on a flexible or hard background. The background can be cut and pasted in any configuration such that one or more light cell (12) is connected to a sister light cell (12) to continue the lighting process without using any separate hard connectivity, electrical wires, PC Board, soldering or any other conventional electrical wiring. The entire system can be powered using one source of electrical power. The placing of the cells on the background material (10) not only keeps the cells adjacent to each other but also helps provide multi dimensional configuration.

In another embodiment of the present invention, the LED light or Electroluminescence (EL) light source (3) fits inside the rings to produce light.

In another embodiment of the present invention, in addition to the copper springs (5) providing improved electrical connectivity between cells, since the copper springs (5) are flexible and as described above, facilitate bending between cells, it is also possible to create arrangements where the cells don't have to be even on the any background but are supported in a particular shape formation by the stability provided by the presence of multiple cells.

In another embodiment of the present invention, when the light cells are placed on a background material (10) such as an adhesive tape, Velcro or a solid surface, a user can cut or tear such background material (10) and place the cut or torn off piece of background material containing light cells anywhere adjacent to the main light cell assembly to create different configurations and shapes including but not limited to circular, hexagonal, octagonal or any geometrical or other shape. There is thus no need to build a connection or hard wire or any other modifications to link the main light cell assembly with the cut or torn off light cell section. It is enough to ensure that the light cells in both the main assembly and torn or cut off portion are in contact with each other, with the copper springs (5) providing improved electrical connectivity between the cells.

In this application, the terminology 'embodiment' can be used to describe any aspect, feature, process or step, any combination thereof, and/or any portion thereof, etc. While the invention has been described in connection with specific embodiments thereof, it will be understood that it is capable of further modifications and this application is intended to cover any variations, uses or adaptations of the invention following, in general, the principles of the invention and including such departures from the present disclosure come within known or customary practice within the art to which the invention pertains and may be applied to the essential features herein before set forth.

Further it will be apparent to those skilled in the art that the objects of this invention have been achieved by providing the above invention. However various changes may be made in the structure of the invention without departing from the concept of the invention. Therefore, the scope of the invention is to be determined by the terminology of the above description and the legal equivalents thereof.

Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

I claim:

1. A novel continuous arrangement of light cells into a multi-dimensional light source comprising:

a primary light cell unit called a mother cell (11);

ancillary light cell units called sisters cells (12);

a background holding material (10);

characterized in that the mother cell (11) contains a large ring (1) with non-conductive material rings (2) and (6) on both sides of the large ring (1), a small ring (4) with non-conductive material (7) on one side of the small ring (4), a light source (3), copper springs (5), and an electrical wire (8).

2. The arrangement of light cells as claimed in claim 1 and working thereof wherein the mother cell (11) connects to an AC or DC electrical power source passing electrical current to the light source (3) via the electrical wire (8) thus powering the light source (3), with the large ring (1) and the small ring (4) in a particular mother cell (11) acting as a connector to any side of a particular sister cell (12) connected to the mother cell (11) and with electrical power being transferred to the remaining sister cells (12) when they are connected to the first sister cell (12).

3. The arrangement of light cells as claimed in claim 1 wherein the copper springs (5) provide electrical connectivity among the mother cell (11) and the sister cells (12).

4. The arrangement of light cells as claimed in claim 1 wherein the background holding material (10) can be hard or flexible including but not limited to adhesive tape, cloth, Velcro, cardboard or a hard surface.

5. The arrangement of light cells as claimed in claim 1 wherein the flexible copper springs (5) facilitate bending between the light cells that can be arranged on any back ground holding material (10) in various configurations to create a particular larger light pattern including but not limited to a straight line, circular, hexagonal, octagonal or any other geometrical shape.

6. The arrangement of light cells as claimed in claim 1 wherein the light cells can be arranged in a particular shape formation supported by the stability provided by the presence of multiple cells and without any background holding material (10).

7. The arrangement of light cells as claimed in claim 1 wherein a user can cut or tear the background holding material (10) containing the light cells and place the cut or torn off piece of background holding material (10) containing the light cells anywhere adjacent to the background holding material (10) containing the mother cell (11) and its sister cells (12) such that the light cells in the cut or torn off piece of background holding material (10) are in contact with the background holding material (10) containing the mother cell (11) and its sister cells (12), to create various configurations including but not limited to a straight line, circular, hexagonal, octagonal or any other geometrical shape.

* * * * *